US006588111B2

(12) United States Patent
Williams

(10) Patent No.: US 6,588,111 B2
(45) Date of Patent: Jul. 8, 2003

(54) UNDERCUT SAW WITH CENTRAL HEIGHT ADJUSTMENT

(76) Inventor: Dan Williams, 26955 Corte Cristal, Temecula, CA (US) 92590

( * ) Notice: Subject to any disclaimer, the term of this patent is extended or adjusted under 35 U.S.C. 154(b) by 0 days.

(21) Appl. No.: 09/852,170

(22) Filed: May 10, 2001

(65) Prior Publication Data

US 2002/0166244 A1 Nov. 14, 2002

(51) Int. Cl.[7] ..... B27B 9/02

(52) U.S. Cl. ..... 30/391; 30/276; 30/373; 30/388

(58) Field of Search ..... 30/388, 389, 390, 30/391, 373, 276; 144/136.95

(56) References Cited

U.S. PATENT DOCUMENTS

| | | | | | |
|---|---|---|---|---|---|
| 1,514,894 | A | | 11/1924 | Carter | |
| 2,610,658 | A | | 9/1952 | Koeling | 143/43 |
| 2,741,282 | A | * | 4/1956 | Wieting | 144/136.95 |
| 3,111,969 | A | | 11/1963 | Bivens | 143/43 |
| 3,443,479 | A | | 5/1969 | Hawley et al. | 90/12 |
| 3,716,917 | A | * | 2/1973 | Ruben | 30/391 |
| D282,142 | S | | 1/1986 | Siravo | D8/66 |
| 4,993,243 | A | * | 2/1991 | Guinn | 30/390 |
| 5,088,865 | A | | 2/1992 | Beth et al. | 409/182 |
| 5,613,813 | A | | 3/1997 | Winchester et al. | 409/182 |
| 5,784,789 | A | | 7/1998 | Vargas | 30/388 |
| 5,815,932 | A | * | 10/1998 | Presher et al. | 30/373 |
| 5,853,274 | A | | 12/1998 | Coffey et al. | 409/182 |
| 5,856,715 | A | * | 1/1999 | Peot et al. | 30/388 |
| 5,967,013 | A | | 10/1999 | McKenzie et al. | 83/483 |
| 5,974,674 | A | | 11/1999 | Kelly | 30/391 |
| 6,050,759 | A | | 4/2000 | Bone | 409/182 |

* cited by examiner

*Primary Examiner*—Hwei-Siu Payer
(74) *Attorney, Agent, or Firm*—Calif Tervo

(57) ABSTRACT

An undercut saw (10) having a central axis (11) generally comprises a cutting assembly (20) and a base (60). Cutting assembly (20) comprises case (30) housing electric motor (24) that drives shaft (40), upon which saw blade (50) is mounted. Base (60) supports cutting assembly (20) above a support surface and comprises cylindrical sleeve (63) supporting case (30) such that central axis (11) is vertical, horizontal portion (94), and vertical leg portion (96) extending down from the periphery of horizontal portion (94) and terminating in foot (98) for resting on a support surface. Case (30) and sleeve (63) are cooperatively adapted such that case (30) can be selectively moved vertically within sleeve (63) and retained in the selected position so as to adjust the height of blade (50) relative to foot (98). In a first preferred embodiment, case (30) and sleeve (63) include cooperating screwing devices for adjusting blade (50) height. Line cord (26) departs motor assembly (22) along central axis (11).

12 Claims, 2 Drawing Sheets

FIG. 2
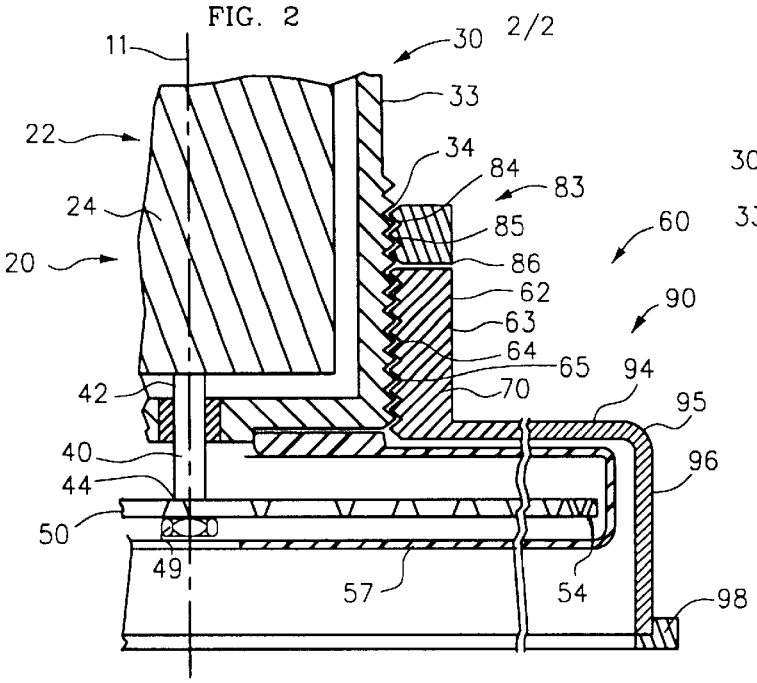
FIG. 6
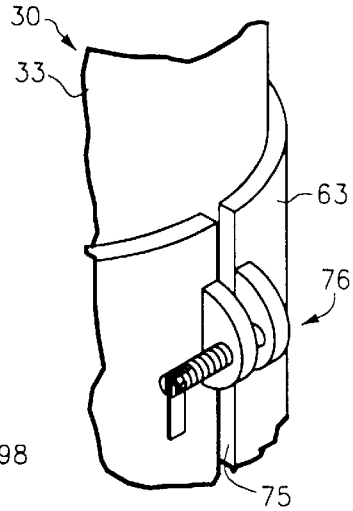
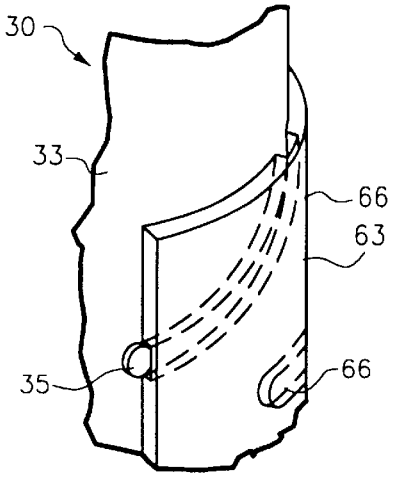
FIG. 3
FIG. 4
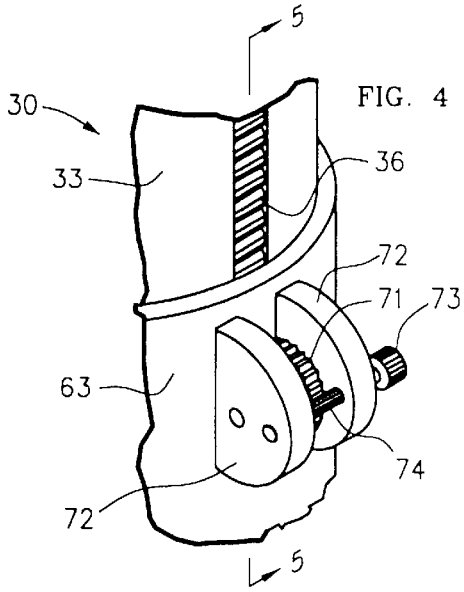
FIG. 7
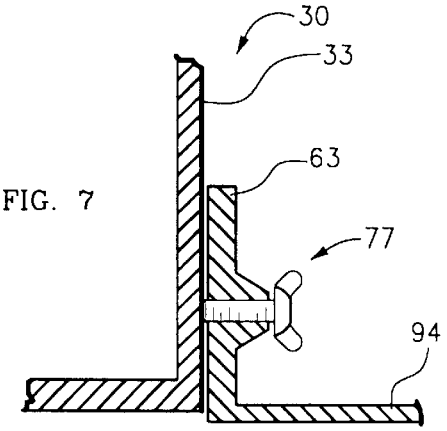
FIG. 5
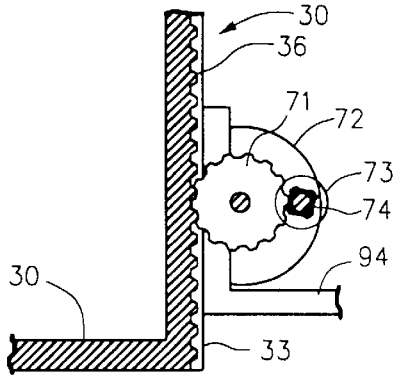

UNDERCUT SAW WITH CENTRAL HEIGHT ADJUSTMENT

FIELD OF THE INVENTION

This invention relates in general to undercut saws, and more specifically involves an undercut saw with a centrally located height adjustment mechanism.

BACKGROUND OF THE INVENTION

Undercut saws or flush-cutting saws are used to undercut doors and baseboards, typically about 0.25 inches to 1.75 inches, to provide sufficient space for floor coverings to fit underneath.

Conventional undercut saws use a cutting assembly including an electric rotary motor driving a shaft rotating a flat, circular cutting blade in a horizontal plane. The cutting assembly is held above a guide surface, such as a floor, by a base which provides a large stable skid surface for sliding the saw along the floor. The base includes an inner portion attached to the cutting assembly, horizontal portion extending radially outward therefrom and past the blade circumference, and an outer generally vertical leg portion extending down from the periphery of the horizontal portion to rest on the floor.

The blade is adjusted vertically by adjusting the height of the leg of the base. Typically, the leg comprises includes inner and outer mating vertically telescopic collars. The relative position of the collars determined in a manner such as the inner collar having a plurality of spaced protruding studs, the outer collar having slots for receiving the studs, and a plurality of wing nuts, each attached to a stud for clamping the collars together.

This peripheral adjustment approach has several shortcomings. Notably, it is slow because several fasteners require adjustment. More importantly, using the peripheral adjustments, it is difficult to adjust the height so that the blade is level. The blade is only level if each of the peripheral clamps, e.g. studs and wingnuts, are at the same height. This is not quickly and easily accomplished.

At least one attempt has been made to provide central height adjustment using an angled drive, but this resulted in an awkward, unbalanced device requiring a large triangular base.

Therefore, there has been a need for an undercut saw with improved mechanism that quickly and accurately adjusts the cutting height while maintaining the blade level and does not otherwise detract from the ergonomics of the saw.

SUMMARY OF THE INVENTION

This invention is an undercut saw having a central axis and it generally comprises a cutting assembly and a base. The cutting assembly comprises a case, housing an electric motor that drives a shaft upon which a saw blade is mounted to rotate in a plane perpendicular to the central axis. The base supports the cutting assembly above a support surface and comprises a cylindrical sleeve horizontally surrounding the motor case and supporting the case such that the central axis is vertical, a horizontal portion extending radially outward from the sleeve and having a periphery past the blade circumference so as to cover said blade except for an exposed cutting area, and a generally vertical leg portion extending down from the periphery of the horizontal portion and terminating in a foot for resting on the support surface. The case and sleeve are cooperatively adapted such that the case may be selectively moved vertically within the sleeve and retained in the selected position so as to adjust the height of the blade relative to the foot.

In a first preferred embodiment, the case and sleeve include cooperating screw means for moving said case vertically in said sleeve upon rotation of said case relative to said sleeve about the central axis. A line cord departs the motor assembly along the central axis.

Other features and many attendant advantages of the invention will become more apparent upon a reading of the following detailed description together with the drawings wherein like reference numerals refer to like parts throughout.

BRIEF DESCRIPTION OF THE DRAWINGS

FIG. 2 is a partial, vertical, cross-sectional view of the saw of FIG. 1 taken on the threaded interface between motor housing and base sleeve.

FIG. 3 is a partial perspective view of a pin and slot height adjustment means.

FIG. 4 is partial perspective view of a rack and pinion height adjusting means.

FIG. 5 is a sectional view taken on line 5—5 of FIG. 4.

FIG. 6 is a partial perspective view of a clamping height adjustment means.

FIG. 7 is a partial cross-sectional view of a set screw height adjustment means, or, alternately, a braking or stopping means.

DETAILED DESCRIPTION OF THE INVENTION

Figure 1:
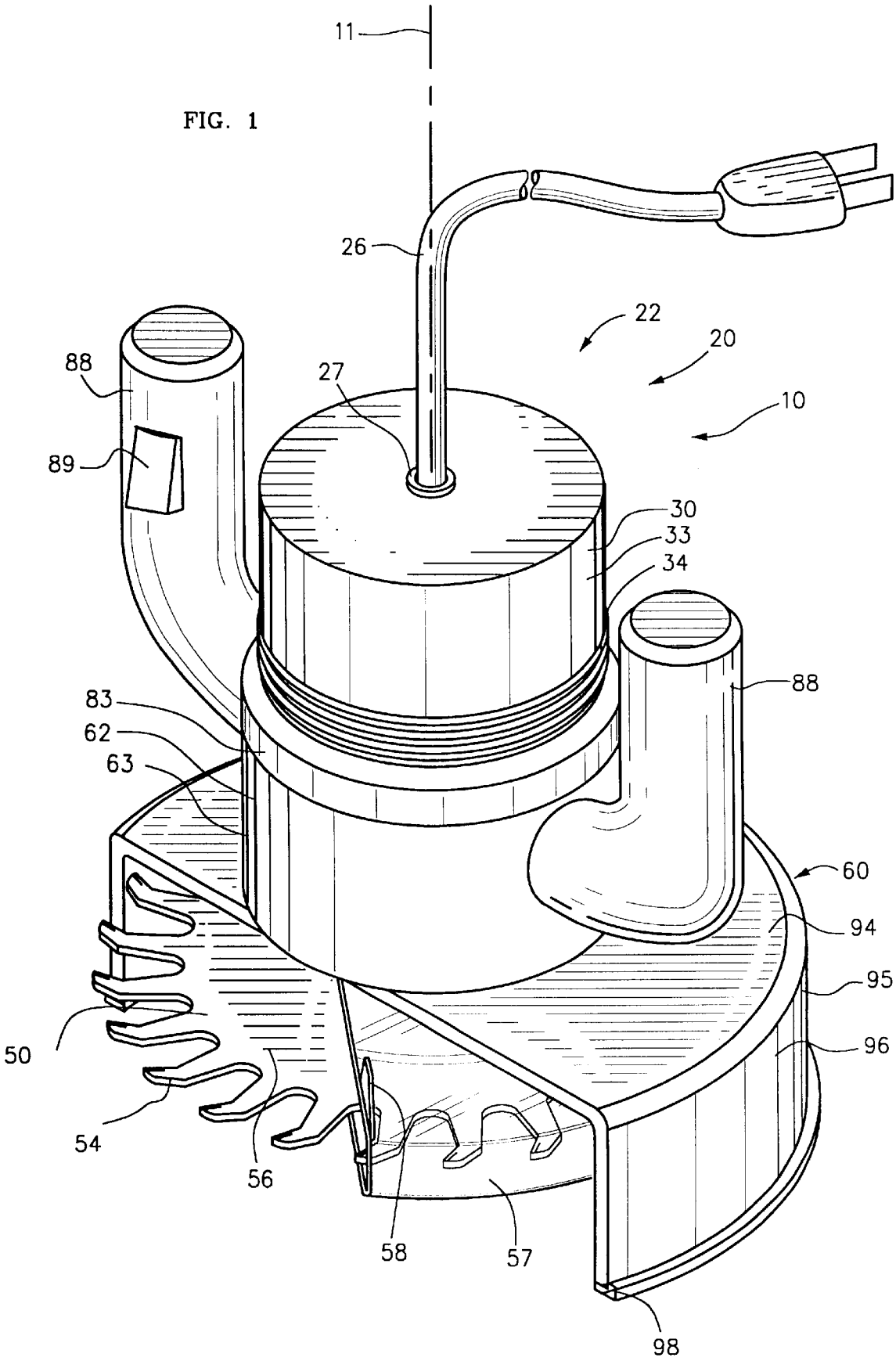
FIG. 1 is a top-front perspective view of a preferred embodiment of the undercut saw of the invention.

With reference now to the drawing, FIG. 1 is a top-front perspective view of a preferred embodiment of the undercut saw 10 of the invention, and FIG. 2 is a partial, vertical, cross-sectional view of the saw 10 of FIG. 1 taken on the threaded interface between motor case 30 and base sleeve 63.

Undercut saw 10 has a central axis 11 and, in general, comprises a cutting assembly 20 and a base 60 for supporting cutting assembly 20.

Cutting assembly 20 comprises a motor assembly 22, a shaft 40, and a cutting tool, such as blade 50. Motor assembly 22 includes an electric motor 24 mounted within case 30 having an outer surface 33, which is typically cylindrical. Electric motor 24 rotates about central axis 11 and turns shaft 40 about central axis 11. Shaft 40 has an upper end 42 connected to and driven by motor 24 and a lower end 44.

Blade 50 is typically a thin, planar cutting blade, such as a steel saw blade, and is attached to lower end 44 of shaft 40, such as by mounting bolt 49, so as to rotate with shaft 40 about central axis 11 in a plane perpendicular to central axis 11. Blade 50 extends radially outward past motor case 30 and terminates radially in a circumferential cutting edge 54. Blade 50 must extend sufficiently radially outward past motor assembly 22 or inner portion 62 of base 60 so as to be able to undercut a door or counter. When blade 50 is making the undercut, motor assembly 22 or inner portion 62 of base 60 contacts the door or counter surface. Thus, the radial extension of blade 50 past motor assembly 22 or inner portion 62 of base 60 is preferably in the range of two to four and a half inches.

Base 60 supports cutting assembly 20 above a support surface. Base 60 comprises an inner portion 62 including a sleeve 63 and an outer portion 90 including a horizontal portion 94 and a generally vertical leg portion 96 terminating in a foot 98 for resting on a support surface, such as a floor.

Sleeve 63 horizontally surrounds motor case 30 and supports case 30 such that central axis 11 is vertical. Sleeve 63 includes an inner surface 64 and an outer surface 70. Typically, sleeve 63 is cylindrical.

Horizontal portion 94 is connected to inner portion 62, such as to lower end of sleeve 63, and extends radially outward therefrom so as to have a periphery 95 radially outward past the largest radius of blade 50 so as to cover blade 50 except for an exposed cutting area 56 on the front of saw 10.

Leg portion 96 extends down from periphery 95 of horizontal portion 94. Foot 98 slides over a support surface and may be made of metal or may be made of rigid plastic or other non-marring material.

Preferably, a blade safety shield 57 is attached to case 30 as is well known in the art and moves vertically with vertical adjustment of motor assembly 22. Safety shield 57 is biased, such as by a spring, to cover cutting area 56 of blade 50 when blade 50 is not in contact with a workpiece. Safety shield 57 is pushed to a retracted position under horizontal portion 94 upon encounter with the workpiece or by the user using retractor 58.

A pair of handles 88 are attached, such as to opposite sides of sleeve 63 for holding by the user for manipulating saw 10. A trigger 89 serves as an on/off switch and may also control motor speed.

Case 30 and sleeve 63 are cooperatively adapted such that case 30 may be selectively moved vertically within sleeve 63 and retained in the selected position so as to adjust the height of blade 50 relative to foot 98.

In the preferred embodiments of FIGS. 1, 2, and 3, sleeve 63 and case 30 include cooperating screw means for moving case 30 vertically in sleeve 63 upon rotation of case 30 relative to sleeve 63 about central axis 11.

A line cord 26 provides electrical power to motor 24. Preferably, at least in the embodiments that adjust by turning case 30, line cord 26 departs motor assembly 22 along central axis 11, such as through grommet 27 in case 30.

In FIGS. 1 and 2, the screw means comprises external helical threads 34 on outer surface 33 of case 30 and cooperating internal threads 65 on inner side 64 of sleeve 63. Locking means, such as locking ring 83, securely retains case 30 in the selected position. A locking ring 83 surrounds case 30 and includes an inner surface 84 including inner threads 85 cooperating with external threads 34 of case 30 so as to move vertically relative to case 30 with rotation of ring 83, and a bottom surface 86 for bearing against the top of sleeve 63 in a locking position wherein rotation of case 30 relative to sleeve 63 is prevented. Other locking means are contemplated, such as a set screw or clamping brake.

FIG. 3 is a partial perspective view of an alternate screwtype adjustment means using cooperating pin 35 and helical slot or channel 66. In the embodiment shown, a plurality of protruding pins 35 are horizontally circumferentially spaced on outer surface 33 of case 30 and a plurality of cooperating helical channels 66 are disposed in inner surface 64 of sleeve 63. A single pin 35 and channel 66 could be used, and, of course, the pins and channels could be reversed. A plurality of channels 66 is preferred because they supply more even vertical forces for even, non-binding and level vertical movement, as is true with the screw threads of FIGS. 1 and 2. A locking mechanism, not shown, such as a brake or set screw, retains the height at the selected position. Pins 35 and channels 66 generally provide for faster height adjustment than threads.

FIG. 4 is a partial perspective view of a rack and pinion height adjusting means. FIG. 5 is a sectional view taken on line 5—5 of FIG. 4. Outer surface 33 of case 30 includes a vertical rack 36 recessed therein. Sleeve 63 includes a pinion 71 supported by ears or supports 72 engaging rack through a slot in sleeve 63 such that rotation of pinion 71 moves base 60 vertically. Pinion drive and locking means include drive knob 73 and drive/locking gear 74. Drive knob 73 is turned to move drive gear 74 for turning pinion 71. The gear ratio and friction in the drive locks pinion 71 from freely turning.

FIG. 6 is a partial perspective view of a clamping height adjustment means. Sleeve 63 includes a vertical slit 75. An adjustable clamp 76 adjusts the width of slit 75. Loosening clamp 76 allows sliding vertical adjustment of case 30 and tightening clamp 76 retains case 30 at the selected height.

FIG. 7 is a partial cross-sectional view of a set screw height adjustment means or, alternately a braking or stopping means. Case 30 of FIG. 7 is vertically slidable in sleeve 63, and sleeve 63 includes stop means, such as set screw 77 for selectively contacting case 30 for stopping case 30 from vertical movement. Alternatively, set screw 77 could be used as a braking or stopping means for the screw adjustments of FIGS. 1–3 interacting between sleeve 63 and case 30 and operating between a first position wherein case 30 can rotate relative to sleeve 63 and a second position resisting relative rotation and holding case 30 at the selected height. Other braking or stopping means are contemplated, such as a clamping brake.

Having described the invention, it can be seen that it provides a very efficient and reliable undercut saw.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. An undercut saw having a central axis; said saw comprising:

a cutting assembly comprising:
- a motor assembly including:
  - a case including:
    - an outer surface; and
  - an electric motor mounted within said case and rotatable about the central axis;
- a shaft including:
  - an upper end connected to said motor for rotation by said motor about the central axis; and
  - a lower end;
- a thin, planar cutting blade attached to said lower end of said shaft so as to rotate with said shaft about the central axis in a plane perpendicular to the central axis;
- said cutting blade extending radially outward past said motor case and terminating radially in a circumferential cutting edge; and a base for supporting said cutting assembly above a support surface;

said base comprising:

an inner portion including:

a sleeve horizontally surrounding said motor case and supporting said case such that the central axis is vertical;

said sleeve including:

an inner surface; and an outer surface; and an outer portion including:

a horizontal portion connected to said inner portion and extending radially outward therefrom and having a periphery past the blade circumference so as to cover said blade except for an exposed cutting area; and a generally vertical leg portion extending down from the periphery of said horizontal portion and terminating in a foot for resting on the support surface; and wherein said case and said sleeve are cooperatively adapted such that said case can be selectively moved vertically within said sleeve to a selected position and retained in the selected position so as to adjust the height of said blade relative to said foot;

wherein said sleeve and said case include cooperating screw means for moving said case vertically in said sleeve upon rotation of said case relative to said sleeve about the central axis;

wherein said screw means comprises external helical threads on said outer surface of said case and cooperating internal threads on said inner surface of said sleeve; and further including:

a locking ring surrounding said case and including:

an inner surface including:

inner threads cooperating with said external threads of said case so as to move vertically relative to said case with rotation of said ring; and a bottom surface for bearing against said sleeve in a locking position wherein rotation of said case relative to said sleeve is prevented.

2. The undercut saw of claim 1, further including a line cord connected to said motor for providing electrical power to said motor; said line cord departing said motor assembly along the central axis.

3. An undercut saw having a central axis; said saw comprising:

a cutting assembly comprising:

a motor assembly including:

a case including:

an outer surface; and an electric motor mounted within said case and rotatable about the central axis;

a shaft including:

an upper end connected to said motor for rotation by said motor about the central axis; and a lower end;

a thin, planar cutting blade attached to said lower end of said shaft so as to rotate with said shaft about the central axis in a plane perpendicular to the central axis;

said cutting blade extending radially outward past said motor case and terminating radially in a circumferential cutting edge; and a base for supporting said cutting assembly above a support surface; said base comprising:

an inner portion including:

a sleeve horizontally surrounding said motor case and supporting said case such that the central axis is vertical; said sleeve including:

an inner surface; and an outer surface; and an outer portion including:

a horizontal portion connected to said inner portion and extending radially outward therefrom and having a periphery past the blade circumference so as to cover said blade except for an exposed cutting area; and a generally vertical leg portion extending down from the periphery of said horizontal portion and terminating in a foot for resting on the support surface; and wherein said case and said sleeve are cooperatively adapted such that said case can be selectively moved vertically within said sleeve to a selected position and retained in the selected position so as to adjust the height of said blade relative to said foot;

wherein said sleeve and said case include cooperating screw means for moving said case vertically in said sleeve upon rotation of said case relative to said sleeve about the central axis;

wherein said screw means comprises a cooperating pin and helical channel in said outer surface of said case and said inner surface of said sleeve.

4. The undercut saw of claim 3 further including a line cord connected to said motor for providing electrical power to said motor; said line cord departing said motor assembly along the central axis.

5. An undercut saw having a central axis; said saw comprising:

a cutting assembly comprising:

a motor assembly including:

a case including:

an outer surface; and an electric motor mounted within said case and rotatable about the central axis; a shaft including:

an upper end connected to said motor for rotation by said motor about the central axis; and a lower end;

a thin, planar cutting blade attached to said lower end of said shaft so as to rotate with said shaft about the central axis in a plane perpendicular to the central axis; said cutting blade extending radially outward past said motor case and terminating radially in a circumferential cutting edge; and a base for supporting said cutting assembly above a support surface; said base comprising:

an inner portion including:

a sleeve horizontally surrounding said motor case and supporting said case such that the central axis is vertical; said sleeve including:

an inner surface; and an outer surface; and an outer portion including:

a horizontal portion connected to said inner portion and extending radially outward therefrom and having a periphery past the blade circumference so as to cover said blade except for an exposed cutting area; and a generally vertical leg portion extending down from the periphery of said horizontal portion and terminating in a foot for resting on the support surface; and wherein said case and said sleeve are cooperatively adapted such that said case can be selectively moved vertically within said sleeve to a selected position and retained in the selected position so as to adjust the height of said blade relative to said foot;

wherein said sleeve and said case include cooperating screw means for moving said case vertically in said sleeve upon rotation of said case relative to said sleeve about the central axis;

wherein said screw means comprises a plurality of cooperating pins and helical channels in said outer surface of said case and said inner surface of said sleeve.

6. The undercut saw of claim 5 further including a line cord connected to said motor for providing electrical power to said motor; said line cord departing said motor assembly along the central axis.

7. An undercut saw having a central axis; said saw comprising:

a cutting assembly comprising:

a motor assembly including:

a case including:

a cylindrical outer surface; and an electric motor mounted within said case and rotatable about the central axis;

a shaft including:

an upper end connected to said motor for rotation by said motor about the central axis; and a lower end;

a thin, planar cutting blade attached to said lower end of said shaft so as to rotate with said shaft in a horizontal plane about the central axis;

said cutting blade extending radially outward past said motor case and terminating radially in a circumferential cutting edge; and a base for supporting said cutting assembly above a support surface;

said base comprising:

an inner portion including:

a cylindrical sleeve horizontally surrounding said motor case and supporting said case such that the central axis is vertical;

said sleeve including:

an inner surface;

an outer surface; and brake means for selective movement between a first position not preventing rotation of said case in said sleeve and a second position resisting relative rotation of said case and said sleeve and holding said case at a selected height;

wherein said brake means includes:

a locking ring surrounding said case and including:

an inner surface including:

inner threads cooperating with external threads of said case so as to move vertically relative to said case with rotation of said ring; and a bottom surface for bearing against said sleeve in a locking position wherein rotation of said case relative to said sleeve is prevented; and an outer portion including:

a horizontal portion connected to said inner portion and extending radially outward therefrom and having a periphery past the blade circumference so as to cover said blade except for an exposed cutting area; and a generally vertical leg portion extending down from the periphery of said horizontal portion and terminating in a foot for resting on the support surface; and wherein said case and said sleeve include cooperating screw means for moving said case vertically in said sleeve upon rotation of said case relative to said sleeve about the central axis;

wherein said screw means comprises external helical threads on said outer surface of said case and cooperating internal threads on said inner surface of said sleeve.

8. The undercut saw of claim 7 further including a line cord connected to said motor for providing electrical power to said motor; said line cord departing said motor assembly along the central axis.

9. An undercut saw having a central axis; said saw comprising:

a cutting assembly comprising:

a motor assembly including:

a case including:

a cylindrical outer surface; and an electric motor mounted within said case and rotatable about the central axis;

a shaft including:

an upper end connected to said motor for rotation by said motor about the central axis; and a lower end;

a thin, planar cutting blade attached to said lower end of said shaft so as to rotate with said shaft in a horizontal plane about the central axis;

said cutting blade extending radially outward past said motor case and terminating radially in a circumferential cutting edge; and a base for supporting said cutting assembly above a support surface; said base comprising:

an inner portion including:

a cylindrical sleeve horizontally surrounding said motor case and supporting said case such that the central axis is vertical; said sleeve including:

an inner surface;

an outer surface; and brake means for selective movement between a first position not preventing rotation of said case in said sleeve and a second position resisting relative rotation of said case and said sleeve and holding said case at a selected height; and an outer portion including:

a horizontal portion connected to said inner portion and extending radially outward therefrom and having a periphery past the blade circumference so as to cover said blade except for an exposed cutting area; and a generally vertical leg portion extending down from the periphery of said horizontal portion and terminating in a foot for resting on the support surface; and wherein said case and said sleeve include cooperating screw means for moving said case vertically in said sleeve upon rotation of said case relative to said sleeve about the central axis;

wherein said screw means comprises a cooperating pin and helical channel in said outer surface of said case and said inner surface of said sleeve.

10. The undercut saw of claim 9 further including a line cord connected to said motor for providing electrical power to said motor;

said line cord departing said motor assembly along the central axis.

11. An undercut saw having a central axis; said saw comprising:

a cutting assembly comprising:

a motor assembly including:

a case including:

a cylindrical outer surface; and an electric motor mounted within said case and rotatable about the central axis;

a shaft including:

an upper end connected to said motor for rotation by said motor about the central axis; and a lower end;

a thin, planar cutting blade attached to said lower end of said shaft so as to rotate with said shaft in a horizontal plane about the central axis;

said cutting blade extending radially outward past said motor case and terminating radially in a circumferential cutting edge; and a base for supporting said cutting assembly above a support surface; said base comprising:

an inner portion including:

a cylindrical sleeve horizontally surrounding said motor case and supporting said case such that the central axis is vertical; said sleeve including:

an inner surface;

an outer surface; and brake means for selective movement between a first position not preventing rotation of said case in said sleeve and a second position resisting relative rotation of said case and said sleeve and holding said case at a selected height; and an outer portion including:

a horizontal portion connected to said inner portion and extending radially outward therefrom and having a periphery past the blade circumference so as to cover said blade except for an exposed cutting area; and a generally vertical leg portion extending down from the periphery of said horizontal portion and terminating in a foot for resting on the support surface; and wherein said case and said sleeve include cooperating screw means for moving said case vertically in said sleeve upon rotation of said case relative to said sleeve about the central axis;

wherein said screw means comprises a plurality of cooperating pins and helical channels in said outer surface of said case and said inner surface of said sleeve.

12. The undercut saw of claim 11 further including a line cord connected to said motor for providing electrical power to said motor;

said line cord departing said motor assembly along the central axis.

* * * * *